US005365682A

United States Patent [19]

Eubank, Jr. deceased

[11] Patent Number: 5,365,682

[45] Date of Patent: Nov. 22, 1994

[54] PICTURE FRAME AND PICTURE HANGER

[75] Inventor: Joseph P. Eubank, Jr. deceased, late of Inverness, Calif., by Mary M. Eubank, executrix

[73] Assignee: Eubank Frame, Inc., Salisbury, Md.

[21] Appl. No.: 609,614

[22] Filed: Nov. 6, 1990

[51] Int. Cl.[5] ..... G09F 1/12

[52] U.S. Cl. ..... 40/152.1

[58] Field of Search ..... 40/152.1, 152

[56] References Cited

U.S. PATENT DOCUMENTS

| | | | |
|---|---|---|---|
| 2,209,972 | 8/1940 | Horwitt | 40/152.1 |
| 3,865,342 | 2/1975 | Kanzelberger | 40/152.1 X |
| 3,952,436 | 4/1976 | Kuhnke | 40/152.1 |
| 3,958,352 | 5/1976 | Eubank, Jr. | 40/152.1 X |
| 4,261,123 | 4/1981 | Mariotti | 40/152.1 X |
| 4,712,761 | 12/1987 | Wassell | 40/152.1 X |
| 4,805,325 | 2/1989 | Cassard | 40/152.1 X |

*Primary Examiner*—Peter R. Brown
*Assistant Examiner*—Milton Nelson, Jr.

[57] ABSTRACT

A picture frame includes a pair of brackets secured in interlocking crossed relation at each corner of a picture assembly. Each bracket includes a turned end for engaging a lateral edge of the picture assembly, and an elongated resilient body extending along the back of the picture assembly perpendicular to the lateral edge engaged by the turned end. The resilient body is angled rearwardly toward the turned end, and the turned end includes an outer web extending forwardly from the resilient body and an end flange joined to the outer web at an acute angle extending lengthwise toward the resilient body and terminating in a contact end. A cord structurally interconnects the pairs of brackets and urges each pair toward a central point on the back of the picture assembly, whereby the resilient bodies are forced forwardly against the back of the picture assembly and the contact ends are forced rearwardly against the front of the picture assembly inwardly from the lateral edges. A picture hanger for the picture assembly includes a support securable on a wall and an arm securable on the back of the picture assembly for engaging the support. A recess is defined between the arm and the back of the picture assembly, and the support extends into the recess. A cord is positioned in the recess to extend over the support for automatically engaging the support in the event that the picture assembly begins to fall.

8 Claims, 2 Drawing Sheets

PICTURE FRAME AND PICTURE HANGER

BACKGROUND OF THE INVENTION

1. Field of the Invention

The invention relates broadly to a frame for holding a picture assembly and to a hanger for hanging the picture assembly on a wall. More specifically, the invention pertains to an improved picture frame for eliminating breakage and/or warping of the picture assembly due to forces exerted thereon by the picture frame. The invention has particular utility in a picture frame of the type disclosed in U.S. Pat. No. 3,958,352 to Eubank, Jr.

2. Description of the Prior Art

U.S. Pat. No. 3,958,352 to Eubank, Jr. discloses an adjustable picture frame including a pair of interlocking frame members positioned on the back surface of a picture assembly at each of the four corners thereof. Each of the frame members includes a generally L-shaped, turned end for engaging a lateral edge of the picture assembly, and a resilient elongated body joined to the turned end to extend perpendicular to the edge of the picture assembly engaged by such end. The turned end is defined by an outer web joined generally perpendicularly to the resilient body, and an end flange joined at a right angle to the outer web to permit the lateral edge of the picture assembly, typically including a picture sandwiched between a transparent cover plate and a backing of paperboard, foamboard or the like, to be held between the end flange and the resilient body. A tensioned cord interconnects the four pairs of frame members to produce truss-like forces on the picture assembly for urging the components of the picture assembly together when hung upon a wall or other like support surface via the cord.

An adjustable picture frame of the type described in U.S. Pat. No. 3,958,352 to Eubank, Jr. possesses numerous structural and functional advantages over conventional picture frames. Conventional picture frames are formed from side pieces or channels cut from a strip of material to correspond to the length of each of the lateral sides of a picture and assembled therearound to continuously overlap the front surface of the picture adjacent its lateral edges. The side pieces must be accurately cut to match the size of a particular picture assembly and the assembled frame, therefore, can only be utilized with a single size picture assembly. Additionally, the side pieces are usually glued, nailed or otherwise permanently secured at their ends to surround the picture assembly, making it difficult to remove and replace pictures with conventional frames. Furthermore, the side pieces in conventional picture frames typically overlap, or cover, the front of the picture continuously along its lateral edges, and this overlap can be as much as several inches inward from the lateral edges of the picture. Conventional frames, therefore, reduce the viewable picture area and frequently require a mat or paperboard border to be placed around the lateral sides of the picture to permit the frame to overlap the mat and not the picture. The mat or border must be cut precisely in accordance with the dimensions of the picture, and cutting the mat and mounting it on the picture requires expertise that is generally possessed only by professional framers. The mat, moreover, adds labor and material costs to the framing procedure and necessitates a larger and, on a material basis, more costly, frame.

In contrast to conventional picture frames, an adjustable picture frame of the type described in U.S. Pat. No. 3,958,352 to Eubank, Jr., includes components that can be easily assembled on and removed from the corners of a picture assembly without any special skill or extraneous securing devices. The subject adjustable picture frame, moreover, is suitable for use on picture assemblies of diverse sizes and configurations, and the end flanges overlap the cover plate and, therefore, the front of the picture, only at discrete locations. Additionally, this overlap is relatively small to maximize the viewable picture area and, when the end flanges are fabricated from a transparent material, the entire picture can be seen. Furthermore, the adjustable picture frame as described herein does not require a mat or border, and can be mounted directly on a picture assembly without any customized sizing of components to obtain material and labor cost savings not found in conventional picture frames.

Although an adjustable picture frame of the type described in U.S. Pat. No. 3,958,352 to Eubank Jr. possesses many attributes, the forces exerted on the picture assembly by the frame members can cause breakage and/or warping of the cover plate if these forces exceed the strength limitations of the cover plate. The tensioned cord urges all four pairs of frame members toward a central point on the back of the picture assembly, and the resilient bodies are forced against the back surface of the picture assembly at locations considerably inward of the lateral edges of the picture assembly. The end flanges, on the other hand, are forced against the front of the picture assembly along their entire length directly adjacent the lateral edges of the cover plate, due to the end flanges being very short and extending over the cover plate only a short distance inward from the lateral edges. A net bending force, or torque, is thus exerted by the end flanges and resilient bodies acting in opposite directions at spaced locations on the picture assembly, resulting in a cantilever effect at the end flanges on the lateral edges of the cover plate. This continuously acting torque tends to bend the lateral edges of the cover plate rearwardly and, if the cover plate is fabricated of a relatively rigid material, such as glass, has the undesirable effect of causing the cover plate to break and shatter. If the cover plate is made from a relatively flexible material, such as plastic, this continuously acting torque has the equally undesirable effect of causing the cover plate to warp. Therefore, the tension induced in the cord must be carefully controlled to avoid exceeding the torque that may safely be applied to the picture assembly by the frame members. In practice, however, it is difficult for a consumer to know the torque limitations of a particular picture assembly when tensioning the cord and, while too great a tension in the cord may cause the cover plate to break or warp, too little tension may result in instability of the picture assembly and separation of the components of the picture assembly being held together by the frame.

Although a variety of picture frames have bent or turned flanges for engaging the edges of a picture assembly, as exemplified in U.S. Pat. Nos. 4,261,123 to Mariotti; 3,981,091 to Wiener, Jr.; 3,529,374 to Spertus and 1,058,348 to Blumenthal, and in French patent 2,274,253, these turned flanges are utilized on conventional side pieces or channels extending continuously along the lateral sides of a picture held by the frame. The side pieces or channels do not exert a net bending force on the picture assembly that might break or warp the picture assembly cover plate and, accordingly, the cantilever effect is neither addressed nor even recognized in the exemplary picture frames.

A further drawback to a picture frame of the type described in U.S. Pat. No. 3,958,352 to Eubank, Jr. is that the tensioned cord is utilized to hang the assembled picture frame from a wall. When plastic sheet is employed for the cover plate, the weight of the picture assembly and frame being carried by the cord causes the cord to pull inwardly on the turned ends of the frame members an increased amount, and results in bowing of the plastic cover plate. An additional disadvantage of a picture frame of the type described in U.S. Pat. No. 3,958,352 to Eubank, Jr., and one that is shared by virtually all types of picture frames that are hung from a wall or other vertical support surface by a cord attached to the back of the picture, involves falling of the picture from the wall in the event of cord detachment, breakage or the like. In addition to cords, other types of hanging devices securable on the back of a picture are susceptible to failure or detachment from the picture, and the inevitable result of these occurrences is falling of the picture from the wall. A picture falling from a hanging position on a wall to the floor is apt to contact the floor with great force, and breakage of the cover plate, if it is glass, and damage to the frame and the picture are typical consequences. Although numerous hanging devices for suspending a picture from a wall have been proposed, as illustrated in U.S. Pat. Nos. 4,029,285 to Tendler; 3,981,091 to Wiener, Jr.; 3,884,443 to McMaster; 3,788,588 to Tendler and 1,269,382 to Butler, none of these hanging devices are utilized with frame members that exert forces on a picture assembly via a tensioned cord interconnecting the frame members, and none suggest a safety mechanism for preventing a picture from falling in the event that the hanging device fails.

SUMMARY OF THE INVENTION

Accordingly, it is an object of the invention to prevent breaking or warping of the cover plate of a picture assembly held together by frame members that exert opposing forces on the front and back of the picture assembly.

It is a further object of the invention to eliminate a cantilever effect on the lateral side edges of the cover plate of a picture assembly subjected to a net bending force acting on the lateral side edges of the cover plate.

Another object of the invention is to provide a picture frame that applies a rearwardly directed force on the front of a picture assembly inward from the lateral edges of the picture assembly and a forwardly directed force on the back of the picture assembly in opposition to the rearwardly directed force.

Yet a further object of the invention is to increase the force that may safely be applied to the front of a picture assembly held together by brackets that apply a rearwardly directed force on the front of the picture assembly and a forwardly directed force on the back of the picture assembly.

Moreover, it is an object of the invention to provide a hanging mechanism for a picture frame having brackets interconnected by a tensioned cord to prevent bowing of the plastic cover plate of a picture assembly held by the brackets.

It is also an object of the invention to prevent a picture from falling to the floor in the event that a hanging device secured on the back of the picture fails.

Moreover, the present invention possesses the advantages of providing an adjustable picture frame that can be assembled directly on diverse sizes and configurations of picture assemblies and disassembled therefrom without the need for any specialized skill or customized frame components. The present invention possesses the additional advantages of maximizing the viewable picture area of a picture assembly without the need for a transitional mat or border, and of increasing cost-effectiveness from both a labor and materials standpoint.

These and other objects, advantages and attributes are achieved with the picture frame and hanger of the present invention as characterized by a picture frame including brackets assembled in pairs in interlocking crossed relation at each of the four corners of a picture assembly. Each bracket includes a turned end for engaging a lateral edge of the picture assembly, and a resilient bent body portion joined to the turned end to extend perpendicular to the lateral edge engaged by the turned end. A flat body portion is joined to the bent body portion and carries contacting surfaces for contacting the back of the picture assembly. The bent body portion is angled rearwardly toward the turned end relative to the contacting surfaces, and the turned end is defined by an outer web extending forwardly from the bent body portion and an end flange joined at an acute angle to the outer web extending lengthwise in the direction of the bent body portion to a contact end. The distance that the outer web extends forwardly from the bent body portion is slightly greater than the thickness of the picture assembly to be engaged by the turned end, and the distance that the end flange extends lengthwise from the outer web to the contact end is approximately equal to the former distance. A tensioned cord interconnects the pairs of bracket members and urges them toward a central point on the back of the picture assembly, whereby the bent body portions are forced forwardly against the back of the picture assembly, and the contact ends of the end flanges are forced rearwardly against the front of the picture assembly inward from the lateral edges of the picture assembly.

The invention further includes a hanger for mounting a picture upon a wall as characterized by a support securable on a wall and having a retaining flange extending angularly forwardly from the wall, and a plate securable on the back of a picture and carrying a vertically depending arm for retention between the retaining flange and the wall. A recess is defined between the arm and the back of the picture when the plate is secured thereon, and the retaining flange extends upwardly into the recess. A cord secured on the back of the picture is positioned horizontally in the recess perpendicular to and closely adjacent the arm to be disposed over the retaining flange, whereby the cord automatically engages the retaining flange in the event that the picture begins to fall.

BRIEF DESCRIPTION OF THE DRAWINGS

The above and still further objects, features and advantages of the present invention will become apparent upon consideration of the following detailed description of specific embodiments thereof, especially when taken in conjunction with the accompanying drawings wherein like reference numerals in the various figures are utilized to designate like components and wherein.

DESCRIPTION OF THE PREFERRED EMBODIMENT

Figure 1:
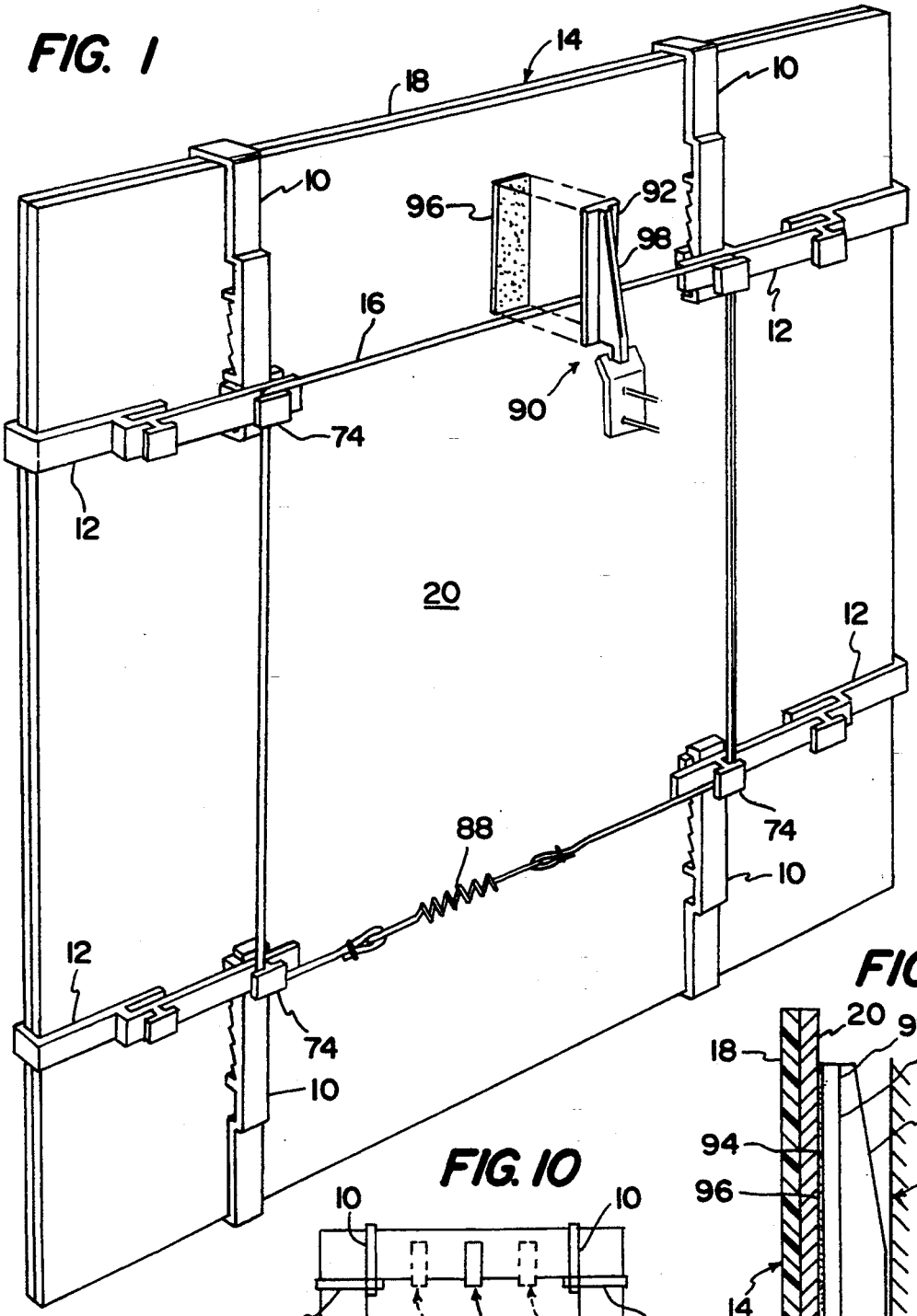
FIG. 1 is a perspective view of the picture frame and picture hanger of the present invention mounted on a picture assembly having a relatively large, square configuration.

With reference to FIGS. 1–6, the picture frame of the present invention includes four pairs of brackets 10 and 12, the brackets 10 and 12 of each pair being disposed in interlocking crossed relation at each corner of a picture assembly 14 and structurally interconnected by a tensioned cord 16. The picture assembly 14 typically includes a picture, such as a painting, poster, photograph or the like, received between a transparent cover plate 18 fabricated from glass, plastic, acrylic or the like, and a backing 20 made from a material such as paperboard or foamboard.

Figure 6:
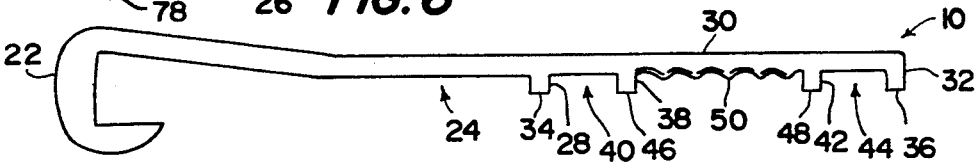
FIG. 6 is a side view of a second bracket for the picture frame of the present invention.

As shown particularly in FIGS. 1 and 6, bracket 10 includes a turned end 22 for engaging a lateral edge of picture assembly 14 joined to an elongated body 24 that extends along backing 20 perpendicular to the lateral edge engaged by turned end 22. Body 24 has substantially constant width and thickness throughout its length and includes a resilient bent portion 26 angularly joined to turned end 22 and extending lengthwise from the turned end to an intermediate post 28, and a generally flat portion 30 joined to intermediate post 28 and extending lengthwise from intermediate post 28 to an end post 32. Intermediate post 28 and end post 32 extend perpendicularly forward from flat portion 30, i.e. toward backing 20, and terminate, respectively, in ends 34 and 36 configured to contact backing 20. A first additional post 38 extends perpendicularly forward from flat portion 30 in spaced relation to intermediate post 28, and a first interlock channel 40 is defined between intermediate post 28 and post 38. A second additional post 42 extends perpendicularly forward from flat portion 30 in spaced relation to end post 32, and a second interlock channel 44 is defined between post 42 and end post 32. Additional posts 38 and 42 terminate, respectively, in ends 46 and 48 configured to contact backing 20 in the same manner as ends 34 and 36. Interlock channels 40 and 44 are configured to alternatively lockingly engage respective cooperating feet on bracket 12, and a series of ridges 50 project forwardly from flat portion 30 between posts 38 and 42 to visually and tactilely identify interlock channels 40 and 44 to ensure proper assembly of brackets 10 and 12. Resilient portion 26 is bent, or angled, rearwardly, i.e. away from backing 20, from a point centrally located lengthwise between turned end 22 and intermediate post 28 in the direction of turned end 22, such that the turned end is normally spaced rearwardly from the horizontal plane defined by the post ends 34, 36, 46 and 48 that contact backing 20.

Figure 5:
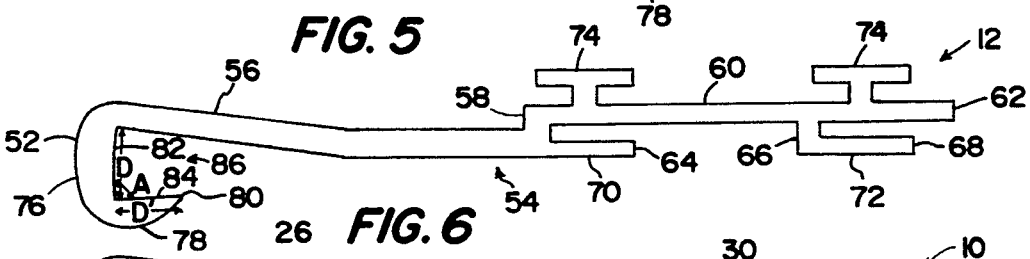
FIG. 5 is a side view of a first bracket for the picture frame of the present invention.

Referring to FIGS. 1 and 5, bracket 12 includes a turned end 52 for engaging a lateral edge of picture assembly 14 joined to an elongated body 54 that extends along backing. 20 perpendicular to the lateral edge engaged by turned end 52. Body 54 has substantially constant width and thickness throughout its length and includes a resilient bent portion 56 angularly joined to turned end 52 and extending lengthwise from the turned end to a first leg 58, and a generally flat portion 60 joined to leg 58 and extending lengthwise from leg 58 to a free end 62. Leg 58 extends perpendicularly forward from flat portion 60 and terminates in a flat foot 64 joined perpendicularly to leg 58 to extend lengthwise toward free end 62 in spaced parallel relation to flat portion 60. A second leg 66 spaced lengthwise from leg 58 extends perpendicularly forward from flat portion 60 and terminates in a flat foot 68 joined perpendicularly to leg 66 to extend lengthwise toward free end 62 in spaced parallel relation to flat portion 60. Feet 64 and 68 include coplanar forward facing surfaces 70 and 72, respectively, for contacting backing 20, and the feet are configured to be alternatively frictionally retained in interlock channels 40 and 44 of bracket 10. A pair of cleats 74 that are T-shaped in longitudinal section project rearwardly from body 54 to be positioned, respectively, proximate feet 64 and 68. Resilient portion 56 is bent, or angled, rearwardly, i.e. away from backing 18, from a point centrally located lengthwise between turned end 52 and leg 58 in the direction of turned end 52, such that the turned end 52 is normally spaced rearwardly from the horizontal plane defined by the forward facing surfaces 70 and 72.

Turned ends 22 and 52 are substantially identical for brackets 10 and 12 and, therefore, only turned end 52 is described in detail herein in connection with bracket 12. As shown in FIG. 5, turned end 52 is formed by body 54 being bent forwardly from resilient portion 56 at approximately a right angle to define an outer web 76 having a forward end that is bent in the same sense at an acute angle A to define an end flange 78 extending lengthwise from outer web 76 in the direction of free end 62 and terminating in a contact end 80. The angle A between outer web 76 and end flange 78 is approximately eighty degrees, and the inner surface 82 of outer web 76 extends forwardly from resilient portion 56 a distance D that is slightly greater than the thickness of picture assembly 14. The inner surface 84 of end flange 78 extends lengthwise from the inner surface 82 in the direction of contact end 80 a distance $D^1$ that is approximately equal to distance D. A space 86 is defined between end flange 78 and resilient portion 56 for receiving a lateral edge of picture assembly 14 to allow the picture assembly to be held between end flange 78 and resilient portion 56. The corners formed between outer web 76 and resilient portion 56 and end flange 78 are rounded to facilitate rearward movement of contact end 80 to engage cover plate 18.

Preferably, brackets 10 and 12 are each fabricated as a unitary, integral molding of transparent plastic or synthetic resin composition, although other materials may likewise be employed. Interlock channels 40 and 44 in bracket 10 are sized and configured to alternatively frictionally retain feet 64 and 68 on bracket 12 when the feet are inserted into the channels in crosswise fashion, and the space between feet 64 and 68 and flat portion 60 of bracket 12 is sized and configured to frictionally retain flat portion 30 of bracket 10.

In operation, a pair of brackets 10 and 12 are positioned in interlocking crossed relation at each corner of a picture assembly 14 by manually slidably inserting a foot 64 or 68 on bracket 12 into an interlock channel 40 or 44 in bracket 10 in accordance with the configuration of the picture-assembly 14. Thus, as shown, respectively, in FIGS. 1–4, foot 68 is inserted into interlock channel 44 for a picture assembly having a relatively large, square configuration; foot 68 is inserted into interlock channel 40 for a picture assembly having a horizontally oriented rectangular picture assembly having a vertically oriented rectangular configuration; and foot 64 is inserted into interlock channel 40 for a picture assembly having a relatively small, square configuration. In each interlocked position, the selected foot is frictionally retained between the posts defining the selected interlock channel, and the flat portion 30 of bracket 10 is frictionally retained in the space defined between the selected foot and the flat portion 60 of bracket 12. The turned ends 22 and 52 of brackets 10 and 12 engage respective perpendicular edges of the picture assembly 14, such that the lateral edges of picture assembly 14 are received in the spaces 86 defined between end flanges 78 and resilient portions 26 and 56, and elongated bodies 24 and 54 extend along backing 20 perpendicular to the picture assembly edge engaged by its turned end. Referring to FIG. 1, cord 16 is wrapped around the four cleats 74 positioned proximate the feet in use to structurally interconnect the four pairs of brackets at the corners of the picture assembly 14. In particular, one end of cord 16 is tied to a first end of a helical spring 88 positioned between the two bottom-most cleats, and cord 16 is run from the first end of spring 88 around the four cleats to the second end of the spring. The remaining free end of cord 16 is tied to the second end of spring 88 to expand the spring, and the thusly tensioned cord urges each of the bracket pairs inwardly from the picture assembly edges toward a central point on the back of the picture assembly 14. The tension applied via cord 16 forces the inner surfaces 82 of webs 76 of the turned ends into abutting contact with a lateral edge of picture assembly 14; forces post ends 34, 36, 46 and 48 and forward facing surfaces 70 and 72 into abutting contact with picture assembly backing 20; flattens resilient portions 26 and 56 by urging them forwardly against backing 20; and forces contact ends 80 of end flanges 78 rearwardly against cover plate 18.

Figure 7:
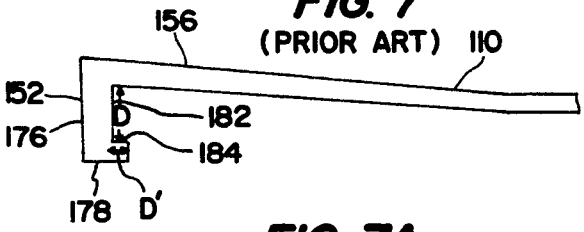
FIG. 7 (PRIOR ART)
FIG. 7 is a broken side view of a prior art frame member.
Figure 7A:
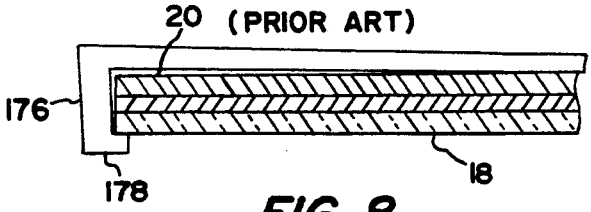
FIG. 7A (PRIOR ART)
FIG. 7A is a broken side view of a prior art frame member holding a picture assembly.

Referring to FIG. 7, a picture frame of the type disclosed in U.S. Pat. No. 3,958,352 to Eubank, Jr. includes frame members 110 having a resilient bent portion 156 joined to a turned end 152 defined by an outer web 176 and an end flange 178 joined at a right angle to outer web 176. End flange 178 extends lengthwise from outer web 176 only a very short distance and the distance $D^1$ that the inner surface 184 of end flange 178 extends lengthwise from the inner surface 182 of web 176 is only around one-third the distance D that the inner surface 182 extends forwardly from resilient portion 156. Referring to FIG. 7A, when the frame members 110 are positioned in pairs at each corner of a picture assembly 14 and structurally interconnected by a tensioned cord, resilient portions 156 are urged forwardly against picture assembly backing 20 at a point considerably inward from the picture assembly edges, while the end flanges 178 are forced rearwardly against the picture assembly cover plate 18 directly adjacent the edges of the picture assembly. The inner surfaces 182 of end flanges 178 are urged into abutting contact with cover plate 18 along their entire length, and a net bending force, or torque, is produced along the picture assembly edges tending to break the cover plate 18, if it is glass, or warp the cover plate, if it is plastic.

Figure 8:
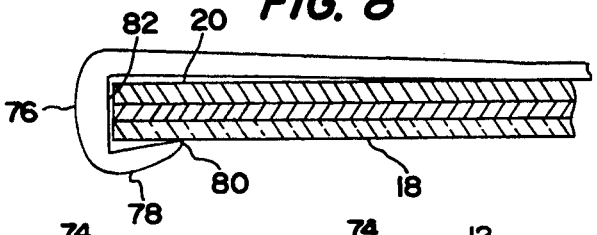
FIG. 8 is a broken side view of a bracket for the picture frame of the present invention holding a picture assembly.

Referring to FIG. 8, when the resilient portions 26 and 56 of brackets 10 and 12 are urged forwardly against picture assembly backing 20, and end flanges 78 of the turned ends are forced rearwardly against cover plate 18, the acute angle between end flanges 78 and webs 76 results in the end flanges being forced against cover plate 18 at contact ends 80 inwardly from the edges of picture assembly 14. Because distance $D^1$ is approximately equal to distance D, contact ends 80 are positioned inwardly of the picture assembly edges a greater amount for a given picture assembly thickness. The tendency of the cover plate 18 to break or warp is thereby eliminated, and the force that can be applied by contact ends 80 against cover plate 18 without damage or deformation to the cover plate is significantly increased.

Figure 10:
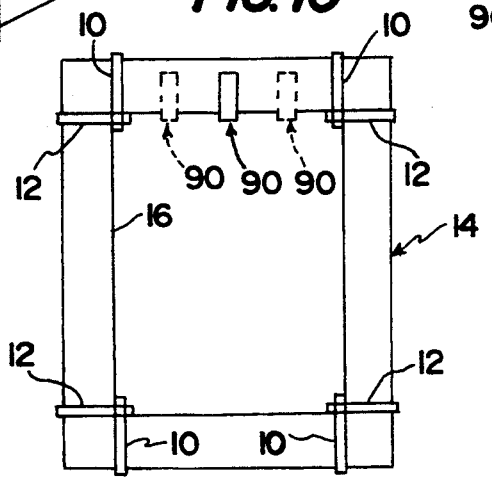
FIG. 10 is a back view of the picture frame of the present invention holding a picture assembly, with the picture hanger of the present invention mounted on the back of the picture assembly.
Figure 2:
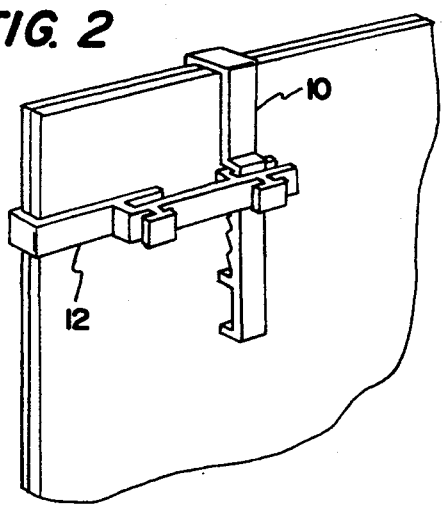
FIG. 2 is a broken perspective view of the picture frame of the present invention holding a picture assembly having a horizontally oriented rectangular configuration.
Figure 3:
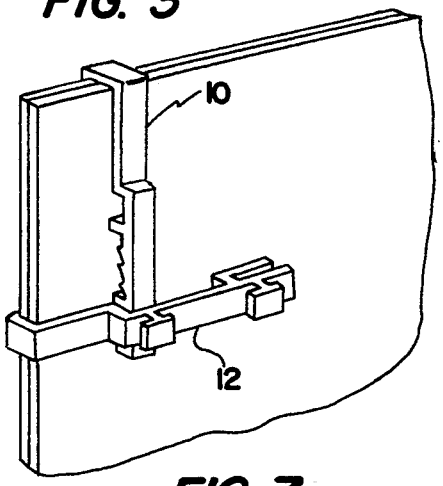
FIG. 3 is a broken perspective view of the picture frame of the present invention holding a picture assembly having a vertically oriented rectangular configuration.
Figure 4:
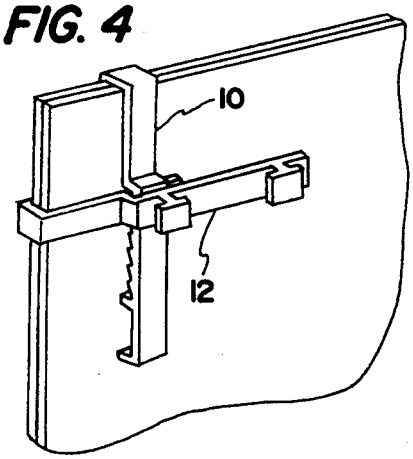
FIG. 4 is a broken perspective view of the picture frame of the present invention holding a picture assembly having a relatively small, square configuration.

Picture frame 10 can be hung from a wall or other vertical support surface by engaging tensioned cord 16 with a nail, a hook or the like on the wall to suspend the picture assembly 14 and frame 10 therefrom. When cover plate 18 is made from plastic, however, the tensioned cord 16 carrying the weight of picture assembly 14 pulls the turned ends 26 and 56 of brackets 10 and 12 inwardly an increased amount and causes the cover plate to bow outwardly from the wall. As depicted in FIGS. 1 and 10, the present invention includes a picture hanger 90 securable to the back of picture assembly 14, such that tensioned cord 16 does not carry the weight of the picture assembly. In this manner, picture frame 10 tightly holds the components of picture assembly 14 together and keeps the picture assembly flat, while picture hanger 90 carries the entire weight of picture frame 10 and picture assembly 14 to eliminate bowing of a plastic cover plate. Depending upon the size and weight of the picture assembly being suspended from the wall, more than one picture hanger 90 can be provided on the back of the picture assembly as shown in FIG. 10.

Figure 9:
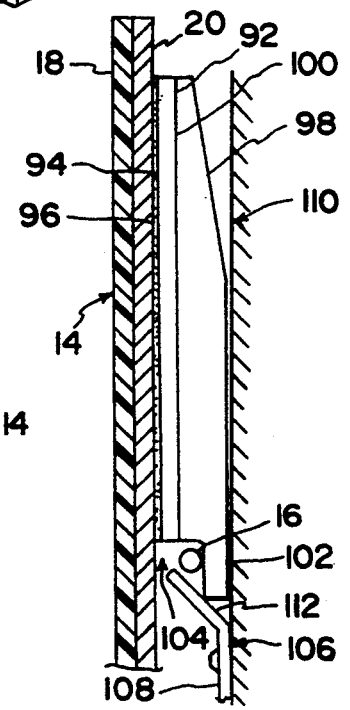
FIG. 9 is a side view of the picture hanger of the present invention.

A picture hanger 90 for use with picture frame 10 is shown in FIGS. 1 and 9, although picture hanger 90 is equally suitable for use with other types of picture frames. Picture hanger 90 includes a plate 92 having a planar forward facing surface 94 secured to one face of a strip 96 of double faced adhesive, the opposite face of such strip being securable to the back of picture assembly 14. An angled shoulder 98 is joined to the rearward facing surface 100 of plate 92 to extend perpendicularly rearward therefrom, and an arm 102 depends vertically from shoulder 98 spaced rearwardly from forward facing surface 94 and generally parallel thereto. A recess 104 is defined between arm 102 and the back of picture assembly 14 when forward facing surface 94 is secured to the back of the picture assembly by strip 96. Cord 16 or another axially elongated structure is secured in a horizontally oriented position on the back of picture assembly 14 to be positioned in recess 104 perpendicular to and closely adjacent arm 102. Picture hanger 90 further includes a support 106 having a leg 108 securable to a wall 110, and a retaining flange 112 extending upwardly from leg 108 in the forward direction, i.e. away from wall 110, to define an acute angle with wall 110 when leg 108 is secured thereto.

In operation, plate 92 is centrally positioned on the back of picture assembly 14 between opposite vertical sides of the picture assembly and proximate its upper horizontal side. Forward facing surface 94 is secured to the back of the picture assembly by adhesive strip 96 to orient arm 102 parallel to the opposing vertical sides of the picture assembly and to position the upper horizontal leg of the cord loop defined by cord 16 in recess 104 perpendicular to and closely adjacent arm 102. In instances where hanger 90 is employed on a picture assembly that is not normally provided with a cord, a cord or other axially elongated structure having first and second free ends can be secured via such ends in a horizontally oriented position on the back of the picture assembly to extend perpendicularly to and closely adjacent arm 102 in recess 104. Leg 108 of support 106 is secured in a desired position on wall 110 by a nail, a screw or the like, and arm 102 is positioned on retaining flange 112 in abutting contact with wall 110 to be retained between retaining flange 112 and the wall. Shoulder 98 is designed and configured to space picture assembly 14 from the wall, and the shoulder can be angled or tapered to urge the lower end of the picture assembly toward the wall when arm 102 is supported on retaining flange 112. Retaining flange 112 is designed and configured to extend into recess 104 forwardly of cord 16, whereby cord 16 automatically engages retaining flange 112 in the event that plate 92 becomes disengaged from picture assembly 14 to prevent the picture assembly from falling to the floor.

Having described a preferred embodiment of a new and improved picture frame and picture hanger constructed in accordance with the present invention, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A picture frame for holding a picture assembly having a front, a back and lateral edges defining a plurality of corners, said picture frame comprising:

bracket means mountable in pairs on each corner of the picture assembly for holding the picture assembly;

means carried on said bracket means for contacting the back of the picture assembly;

resilient body means angularly joined to said contacting means for engaging the back of the picture assembly at locations inwardly spaced from the lateral edges;

substantially flat body means joined to said resilient body means for carrying said contacting means;

turned end means angularly joined to said resilient body means for engaging the front of the picture assembly, said end means including web means angularly joined to said resilient body means for engaging a lateral edge of the picture assembly and flange means joined to said web means at an acute angle of approximately eighty degrees to extend toward said resilient body means, said flange means terminating at contact ends for engaging the front of the picture assembly, said resilient body means being angled relative to said contacting means to extend toward said end means in a direction away from said contact ends;

cooperating engaging means on said bracket means for securing said bracket means in pairs in crossed relation at each corner of the picture assembly to position said web means to engage a lateral edge of the picture assembly and to position said resilient body means to extend along the back of the picture assembly perpendicular to the engaged edge, said cooperating engaging means including at least a first pair of spaced post means on said flat body means of one of the bracket means of each pair and a second pair of spaced post means on said flat body means of said one bracket means spaced from said first pair of post means, said first and second pairs of post means extending perpendicularly from said flat body means toward said contacting means on said one bracket means, and at least a first foot means on said flat body means of the other of said bracket means of each pair and a second foot means on said flat body means of said other bracket means spaced from said first foot means, said first and second foot means extending toward said contacting means on said other bracket means for being frictionally retained alternatively between said first and second pairs of spaced post means, said first pair of post means defining first channel means in said flat body means and said second pair of post means defining second channel means in said flat body means spaced from said first channel means for alternatively frictionally retaining said first and second foot means;

a recess in said flat body means separating said first and second channel means;

indicia means carried on said flat body means of said one bracket means for visually distinguishing said first and second channel means from said recess; and means for interconnecting all of said pairs of said bracket means to urge said pairs of bracket means toward a central location on the back of the picture assembly, whereby said resilient body means are forced in a forward direction against the back of the picture assembly at locations spaced from the lateral edges, said flange means are forced in a rearward direction against the front of the picture assembly to engage the front of the picture assembly with said contact ends at locations inwardly spaced from the lateral edges, and said web means are forced against the lateral edges in an inward direction toward the central location.

2. A picture frame as recited in claim 1 wherein said indicia means includes ridge means projecting into said recess on said flat body means of said one bracket means to extend between said first and second channel means for visually and tactilely identifying said first and second channel means.

3. A picture frame for holding a picture assembly having a front surface, a back surface, a thickness between the front and back surfaces and lateral edges defining a plurality of corners in combination with a hanger for mounting the picture assembly on a wall, said combination comprising:

a picture frame including bracket means mountable in pairs on each corner of the picture assembly for holding the picture assembly, contacting means carried on said bracket means for contacting the back surface of the picture assembly, resilient body means angularly joined to said contacting means for engaging the back surface of the picture assembly at locations inwardly spaced from the lateral edges, turned end means angularly joined to said resilient body means for engaging the front surface of the picture assembly, said end means including web means angularly joined to said resilient body means and extending from said resilient body means a first distance slightly greater than the thickness of the picture assembly for engaging a lateral edge of the picture assembly along the thickness, and flange means extending angularly from said web means at an acute angle toward said resilient body means a second distance substantially equal to said first distance and terminating at contact ends for engaging the front surface of the picture assembly, said resilient body means being angled relative to said contacting means to extend toward said end means in a direction away from said contact ends, cooperating engaging means on said bracket means for securing said bracket means in pairs in crossed relation at each corner of the picture assembly to position said web means to engage a lateral edge of the picture assembly and to position said resilient body means to extend along the back surface of the picture assembly perpendicular to the engaged edge, means for interconnecting all of said pairs of bracket means to urge said pairs of bracket means toward a central location on the back surface of the picture assembly, whereby said resilient body means are forced in a forward direction against the back surface of the picture assembly at first locations inwardly spaced from the lateral edges and said flange means are forced in a rearward direction against the front surface of the picture assembly to engage the front surface with said contact ends at second locations inwardly spaced from the lateral edges and disposed between the lateral edges and said first locations, and cleat means on one of said bracket means of each of said pairs for engaging said interconnecting means, said interconnecting means including tensioned cord means disposed around said cleat means for urging said pairs of bracket means toward a central point on the back of the picture assembly; and a hanger including plate means for being secured on the back surface of the picture assembly, arm means depending from said plate means for defining with the back surface a cavity disposed below said plate means and support means for being secured on the wall, said support means having retaining means disposed angularly with the wall when said support means is secured thereon for supporting said arm means on said retaining means when said retaining means is positioned in said cavity, said cord means being positionable in said cavity to extend over said retaining means when said arm means is supported thereon, whereby said cord means automatically engages said retaining means and is supported thereon in the event that the picture assembly begins to fall.

4. A hanger for hanging a picture having a front and a back from a wall, said hanger comprising:

support means for being secured on a wall for supporting the weight of the picture;

primary hanging means for being secured on the back of the picture to be supported on said support means; and secondary hanging means for being secured on the back of the picture to be disposed over said support means when said primary hanging means is supported thereon, whereby said secondary hanging means automatically engages said support means and is supported thereon in the event that the picture begins to fall.

5. A hanger as recited in claim 4 wherein said support means includes retaining means projecting angularly from the wall for retaining said primary hanging means in resting engagement on said support means between said retaining means and the wall and supporting said secondary hanging means in the event that the picture begins to fall.

6. A hanger as recited in claim 5 wherein said primary hanging means includes arm means spaced from the back of the picture when said primary hanging means is secured thereon for being supported in resting engagement on said support means between said retaining means and the wall.

7. A hanger as recited in claim 6 further including cavity means, defined between said arm means and the back of the picture when said primary hanging means is secured thereon, for receiving said retaining means therein when said arm means is retained between said retaining means and the wall, and wherein said secondary hanging means is positionable in said cavity means to be disposed over said retaining means.

8. A hanger as recited in claim 7 wherein said secondary hanging means includes a cord positionable in said cavity means to extend over said retaining means.

* * * * *